US005158623A

United States Patent [19]

Michaud et al.

[11] Patent Number: 5,158,623

[45] Date of Patent: Oct. 27, 1992

[54] METHOD FOR SURFACE REFINEMENT OF TITANIUM AND NICKEL

[75] Inventors: Mark D. Michaud, Bristol; Robert G. Zobbi, Southbury, both of Conn.

[73] Assignee: Rem Chemicals, Inc., Southington, Conn.

[21] Appl. No.: 733,848

[22] Filed: Jul. 22, 1991

Related U.S. Application Data

[62] Division of Ser. No. 502,515, Mar. 30, 1990, Pat. No. 5,051,141.

[51] Int. Cl.[5] ..... C23C 7/06

[52] U.S. Cl. ..... 148/269

[58] Field of Search ..... 148/269, 270, 271

[56] References Cited

U.S. PATENT DOCUMENTS

| | | | |
|---|---|---|---|
| 2,856,275 | 10/1958 | Otto | 41/42 |
| 2,864,732 | 12/1958 | Miller et al. | 148/6.15 |
| 2,881,106 | 4/1959 | Lipinski | 148/6.24 |
| 3,989,876 | 11/1976 | Moji et al. | 428/472 |
| 4,023,986 | 5/1977 | Kessler | 148/6.14 |
| 4,075,040 | 2/1978 | Villain | 148/6.14 |
| 4,101,440 | 7/1978 | Akagi et al. | 252/186 |
| 4,394,224 | 8/1983 | Mahoon et al. | 204/57 |
| 4,491,500 | 1/1985 | Michaud et al. | 156/628 |
| 4,705,594 | 11/1987 | Zobbi et al. | 156/637 |
| 4,818,333 | 4/1989 | Michaud | 156/628 |
| 4,846,897 | 7/1989 | Nakagawa et al. | 148/251 |
| 4,906,327 | 3/1990 | Michaud et al. | 156/637 |

*Primary Examiner*—Sam Silverberg
*Attorney, Agent, or Firm*—Ira S. Dorman

[57] ABSTRACT

A composition for use in the physicochemical surface refinement of objects having surfaces of titanium, nickel, and alloys of each, normally in a vibratory mass finishing process, comprises the combination of sulfamic acid, ammonium bifluoride, and hydrogen peroxide. The maximum concentration of the peroxide is controlled to avoid inhibiting or arresting the reaction with the metal; maintaining a minimum concentration prevents excessive metal dissolution, pitting and other undesirable surface defects.

6 Claims, No Drawings

METHOD FOR SURFACE REFINEMENT OF TITANIUM AND NICKEL

This is a divisional of copending application(s) Ser. No. 07/502,515 filed Mar. 30, 1990 now U.S. Pat. No. 5,051,141.

BACKGROUND OF THE INVENTION

A physicochemical process for refining metal surfaces is described and claimed in Michaud et al U.S. Pat. No. 4,491,500, issued Jan. 1, 1985, which process involves the development, physical removal and continuous repair of a relatively soft coating on the surface. The mechanical action required is preferably generated in a vibratory mass finishing apparatus, and very smooth and level surfaces are ultimately produced in relatively brief periods of time.

Zobbi et al U.S. Pat. No. 4,705,594, issued Nov. 10, 1987, provides a composition for use in the physicochemical mass finishing of metal surfaces of objects. The composition includes oxalic acid, sodium nitrate, and hydrogen peroxide, so formulated as to rapidly produce highly refined surfaces.

Michaud U.S. Pat. No. 4,818,333, issued Apr. 4, 1989, provides a physicochemical process for refining relatively rough metal surfaces to a condition of high smoothness and brightness, which is characterized by the use of a non-abrasive, high-density burnishing media.

In U.S. Pat. No. 4,906,327, issued Mar. 6, 1990, Michaud et al provide a method and composition for the physicochemical refinement of magnetic stainless steel objects.

Although the processes and chemical compositions of the foregoing inventions are most effective and satisfactory for their intended purposes, as far as is known there has not heretofore been provided a physicochemical process that is adapted for the refinement of surfaces constituted of titanium, nickel, or alloys of those metals, nor has there been provided a composition for use in such a process.

The prior art discloses a wide variety of compositions for treating titanium and/or nickel surfaces for various purposes. For example, Lipinski U.S. Pat. No. 2,881,106 discloses a method for increasing the bondability of organic polymeric materials to titanium surfaces, by treatment of the latter with an acidic (pH 3 or lower) solution containing sulfamic acid and fluoride ion. The sulfamic acid may be employed in a concentration of about 1–40 weight percent, although from a practical standpoint the upper limit appears to be 20 percent; the concentration of fluoride ion employed is 0.1 to 10, and preferably not more than 5 weight percent, and the sulfamic acid and fluoride compound are present in a weight ratio of 5 to 100:1. Treatment with the solution is said to remove the inherent oxide layer, to etch the titanium surface, and produce a film that causes the etching action to cease, the film being characterized as the reaction product of sulfamic acid and titanium.

Mahoon et al U.S. Pat. No. 4,394,224 teaches the use of sodium hydroxide/hydrogen peroxide mixtures to etch titanium surfaces and to produce an oxide layer thereupon. Activity of the composition can be enhanced by use of a catalyst, or by electrolytic techniques.

Otto U.S. Pat. No. 2,856,275 provides compositions for pickling titanium and its alloys, augmented with hydrogen peroxide or other oxidizing agent; the basic pickling solution will typically consist of a mixture of nitric and hydrofluoric acids. Use of the formulation is said to produce a clean, brilliant surface, free from any oxide film.

Akagi et al U.S. Pat. No. 4,101,440 discloses compositions containing sulfamic acid and hydrogen peroxide for effecting the release of photoresist films.

In accordance with Miller et al U.S. Pat. No. 2,864,732, a solution of a halide (e.g., fluoride), and alkali or alkaline earth metal, and an anion (e.g., phosphate, borate, oxalate, citrate, and tartrate) is used to produce a coating upon a titanium surface. Moji et al U.S. Pat. No. 3,989,876 is similar, but expressly teaches applicability to nickel and its alloys, as well. Other United States patents that generally disclose the presence of fluorides in compositions for treating titanium surfaces include Kessler U.S. Pat. Nos. 4,023,986, Villian 4,075,040 and Nakagawa et al 4,846,897.

Despite such teachings of the prior art, a demand remains for compositions, aqueous solutions, and methods that are effective for use in the physicochemical refinement of titanium and/or nickel surfaces.

Accordingly, the broad objects of the present invention are to provide novel compositions, and novel aqueous solutions which may be made from them, which solutions are effective for the physicochemical refinement of metal-surfaced objects, and particularly those having surfaces constituted of titanium or nickel (by use of which terms it is intended to encompass alloys consisting predominantly of one of those metals), by the mass finishing thereof.

A related object is to provide novel mass finishing processes utilizing such solutions, or other solutions that are capable of converting such metals to substantially pure oxide forms under normal vibratory mass finishing conditions.

Related objects of the invention are to provide such compositions, solutions and processes, by which physicochemical surface refinement is achieved at high rates of speed, with highly uniform metal removal, and without significant pitting, etching, corrosion, intergranular attack, or hydrogen embrittlement of the workpiece surfaces; and to provide such compositions, solutions and processes which are used and carried out with particular effectiveness in open, vibratory mass finishing equipment.

SUMMARY OF THE INVENTION

It has now been found that certain of the foregoing and related objects of the invention are attained by the provision of a composition comprising an aqueous solution of water, 0.04 to 1.17 gram moles per liter of a sulfamic acid compound selected from the group consisting of sulfamic acid and water-soluble derivatives thereof, 3.16 to 0.03 gram mole per liter of fluoride ion, and a 0.02 to 0.60 gram mole per liter of a water-soluble peroxy compound, the solution having a pH of about 1.0 to 4.0.

In preferred embodiments, the solution will contain 0.08 to 0.29 gram mole per liter of the sulfamic acid compound and 0.78 to 0.05 gram mole per liter of the fluoride ion, and the concentration of the peroxy compound will vary in direct relationship to the combined concentrations of the sulfamic acid compound and the fluoride ion. That is, at high concentrations of those constituents an amount of peroxy compound corresponding to the foregoing upper limit may be utilized to advantage; when the concentrations of the sulfamic acid and fluoride-furnishing compounds are in the preferred range, the maximum amount of the peroxy compound should be from about 0.12 to 0.29 gram mole per liter.

In especially preferred embodiments, the solution will consist essentially of water, a mixture of the sulfamic acid compound and a bifluoride compound, and the peroxy compound, with the sulfamic acid compound constituting 75 to 90 weight percent of the mixture and the bifluoride compound conversely constituting 25 to 10 weight percent thereof. In such a case the mixture will preferably be admixed with the water in an amount ranging from 15 to 60 grams per liter thereof, and the peroxy compound will be admixed in an amount ranging from 0.12 to 0.29 gram mole per liter of water. Most desirably, the sulfamic acid compound employed will be sulfamic acid, the bifluoride compound will be ammonium bifluoride, and the peroxy compound will be hydrogen peroxide, at a concentration of 4 to 10 grams per liter.

Other objects of the invention are attained by the provision of a composition for addition to water to provide an aqueous solution containing the ingredients hereinabove set forth, in the amounts specified. The composition may be solid under ambient conditions and in the form of a substantially dry powder, in which case the peroxy compound will advantageously be selected from the group consisting of sodium perborate, sodium percarbonate, sodium persulfate, ammonium persulfate, potassium perborate, potassium persulfate, and urea peroxide.

Additional objects of the invention are attained by the provision of a process for the refinement of titanium or nickel surfaces of objects, including a step of introducing, into the container of a mass finishing unit, a mass of elements comprising of a quantity of mass finishing media and a mass of objects with metal surfaces, the metal being selected from the group consisting of titanium, nickel, and alloys containing titanium or nickel as the primary constituent. The mass of elements is wetted with a refining solution that is capable of reacting (under the conditions of operation) with the surface metal to produce a physically removable coating thereon, and the mass is rapidly agitated while maintaining the surfaces in a wetted condition with the solution. The agitation produces relative movement and contact among the elements, and is continued for a period of time sufficient to effect a significant reduction in roughness of the surfaces. The refining solution employed may be comprised as hereinabove set forth, or it may be any aqueous solution that is capable of converting the surface metal to a substantially pure oxide form. In any event, the agitation step will normally produce substantial aeration, and thereby continuous oxygenation, of the solution.

The mass finishing media employed will preferably consist of relatively heavy and nonabrasive solid media elements of a kind that is generally employed for burnishing purposes, and of a size and in an amount selected to promote, under the conditions of agitation maintained, relative sliding movement thereamong and with respect to the objects. Such media elements will be composed of a mixture of oxide grains fused to a coherent mass, with a density of at least about 2.75 grams per cubic centimeter. The media elements will be substantially free from discrete abrasive particles, and will have a bulk density of at least about 1.70 grams per cubic centimeter. The composition of the media elements will generally be such that an average weight reduction of less than about 0.1 percent per hour will be occasioned by agitation in a vibratory bowl having a capacity of about 280 liters, substantially filled with the elements and operated at about 1,300 revolutions per minute and an amplitude of 4 millimeters, with a burnishing soap solution flowing through the bowl at the rate of about 11 liters per hour.

DETAILED DESCRIPTION OF THE PREFERRED EMBODIMENTS

Exemplary of the efficacy of the present invention are the following specific examples. In all instances a four-cubic foot, flat-bottom vibratory bowl was used, set at an amplitude of 4 millimeters and a lead angle of 70°. The media employed was composition "C" of the above-mentioned U.S. Pat. No. 4,818,333, in the form of angle-cut (25°) elements of elliptical cross section, measuring about 1.4 centimeters (cm) wide, 0.6 cm thick, and 2.2 cm long, and being fully conditioned or broken-in, prior to use, in the manner described in the foregoing patent.

All tests were carried out with the bowl of the vibratory unit loaded with 50 titanium alloy (6% aluminum, 4% vanadium, 90% titanium) turbine blades, used as metal fillage to simulate production conditions; the blades were of assorted sizes ranging from 7.6×3.8 cm to 17.8×6.4 cm (length by cord width). In addition to the fillage blades, individually identified blades, of the same titanium alloy, were used to demonstrate the test results. During operation, the temperature in the vibratory bowl remained in the range of 27° to 32° Centigrade. Surface roughnesses are expressed by arithmetic average roughness (Ra) values, as determined using a T-1000 Hommel profilometer (commercially available from Hommelwerke GmbH).

EXAMPLE ONE

Part A

The following ingredients were mixed into about 114 liters of water, at a temperature of 27° Centigrade, to provide a refining solution: 2.72 kilograms of sulfamic acid; 820 grams of ammonium bifluoride; and 1,100 milliliters of a standard 35% hydrogen peroxide reagent, representing approximately 0.38% by weight of the solution; the pH value was about 1 to 1.5. A badly pitted titanium blade, nominally measuring 7.6 cm in length and 5 cm in cord width, was used as the test piece for monitoring the effectiveness of the refinement operation; it had the following characteristics: an Ra of 103 microinches, a weight of 54.307 grams, an unsoiled surface free of foreign matter, a silver/gray color, and edges that were burred, square and sharply defined.

The test blade was placed in the vibratory bowl along with the fillage blades. Operation of the bowl was commenced, and the working solution was delivered to the vibratory bowl on a flow-through basis at a rate of 5.7 liters per hour; the rate was sufficient to maintain a well-wetted condition, but was less than would allow a pool of liquid to collect (i.e., drainage was adequate). There was no odor or apparent fuming from the bowl, and the discharged solution was yellow in color with a pH value of about 1 to 1.5.

A flat white coating developed on the parts, with a random, rubbed pattern on the surfaces contacted by the media moving thereacross. After processing under these conditions for 48 hours, the test part was removed and inspected; it was found that the pits and other surface imperfections originally present had been fully removed.

Flow of the refining solution was stopped, and a 1% standard alkaline soap solution, having a pH of 9, was substituted to neutralize the system and burnish the parts; the soap solution was delivered at a rate of 49 liters per hour on a flow-through basis, for 1.5 hours. The flat white surface color was thereby removed, and upon further evaluation the balde was found to have specular bright surfaces free from imperfections, and an Ra value of 2 microinches. The gross weight of the thus physicochemically refined blade was 50.432 grams, and its cord width had been reduced by only 1.07 millimeters (slightly more than 2 percent); it had finely radiused edges.

Part B

Using the same bowl, media, and operating conditions, a second, substantially identical test blade of similarly pitted condition was processed, utilizing however only the standard alkaline burnishing soap described (i.e., no active refining solution), delivered at a rate of 49 liters per hour. The blade had an original Ra value of 104 microinches, a starting weight of 54.312 grams, and a clean surface free of foreign matter; it was silver/gray in color and had edges that were burred and sharply defined.

The test part was placed into the vibratory bowl along with the fillage blades, the bowl was started, and the alkaline soap flow was commenced; operation was continued for 49.5 hours (i.e., the processing time was the same as the total amount of time employed in Part A). The test blade showed no significant refinement, and the edges remained square and sharp (albeit that the burrs had been flattened somewhat); it had a final Ra value of 96 microinches and weight of 54.209 grams, and it was bright but still badly pitted.

Part C

One liter of the same solution that was employed in Part A hereof was placed into a beaker, together with a badly pitted test blade substantially identical to those previously used. The part was allowed to stand in the solution at room temperature for a period of 24 hours, without agitation or relative movement. Vigorous gassing from the blade surface was observed throughout the test period, at the end of which the part was removed and inspected. Severe erosion was seen to have occurred, causing a reduction in the cord width of the blade of approximately 25 percent, and gas flow and etching patterns were evident.

EXAMPLE TWO

A milled titanium blade, having an Ra value of 100 microinches and showing pronounced mill marks, was processed in a manner identical to that employed in Example One, Part A, using the same refining solution. Processing therein was carried out for 42 hours, and burnishing was effected for an additional 1.5 hours. The surface thereby produced on the test blade was free from milling marks and other imperfections; it was specular bright, with an Ra value of 2.3 microinches.

One of the fillage blades was removed at the end of the refinement cycle (i.e., before flow of the burnish solution was begun), and carefully rinsed and dried. Using scanning auger microscopy, the white surface produced on the part was analyzed and found to be substantially pure titanium oxide, approximately 100 angstroms thick. No sulfur or fluorine compounds were in evidence, contrary to what might have been expected.

EXAMPLE THREE

The procedure of Part A of Example One was repeated, using the refining solution defined therein but omitting the hydrogen peroxide. A pitted blade, substantially identical to that used in the Part A Example, was processed in the solution for 48 hours. The part became gray/black in appearance, its surface was etched and remained pitted, and its weight decreased by 10.9 grams; the discharged solution was red/brown in color. This test indicates that metal dissolution, rather than physicochemical refinement, results when the peroxide constituent is omitted from the refining solution.

EXAMPLE FOUR

Again the test of Example One, Part A, was repeated, but with the original hydrogen peroxide concentration reduced to 25 percent of the amount employed therein. A pitted blade, substantially identical in starting conditions to that previously described, was run for 48 hours. A flat-white coating was produced, and the surface was ultimately found to be free from pits and other imperfections; the blade lost only 4.1 grams of metal. Thus, the reduced-peroxide formula appears to be equally as effective for physicochemical refinement as the original formulation.

EXAMPLE FIVE

In this test the hydrogen peroxide concentration of the solution of Part A, Example One, was raised to about 1.9% by weight, all other conditions (including those of the blade) being substantially unchanged. During processing the test part became shiny bright in appearance, and the discharged solution was of a yellow color. After 48 hours of operation the part remained badly pitted; indeed, the higher peroxide concentration had evidently slowed, or essentially arrested, the refinement process. The edges of the test blade remained square, and the blade had lost 0.68 gram of metal.

EXAMPLE SIX

A 113 liter working solution was made up to contain 3.36 kilograms of sulfamic acid, 180 grams of ammonium bifluoride, and 1,100 ml of 35% aqueous hydrogen peroxide; it had a pH value of 1 to 1.5. A pitted blade, identical in starting conditions to that used in Example One, Part A, was processed in the vibratory bowl for 48 hours, under the conditions described in that test, thereby producing a flat-white surface, free from pits. The solution appears to be equally as effective as that of the original Example.

EXAMPLE SEVEN

A 113 liter working solution was made up to contain 1.36 kilograms of sulfamic acid, 2.18 kilograms of ammonium bifluoride, and 1,100 ml of 35% aqueous hydrogen peroxide; the solution had a pH value of 2.5 to 3. A pitted blade, identical in starting condition to that used in Example One, Part A, was run for 48 hours. Again, examination of the test part shows the solution to be as equally effective as that of Part A of the first Example.

Successful use of the formulations of the invention appears to depend upon the maintenance of adequate supplies of both the fluoride ion and also the peroxy group. It has been found that an excessive concentration of the peroxy compound can have an inhibiting effect upon the reaction by which the oxide is formed on the metal surface, completely arresting it under certain circumstances. This may be due to an inadequate balance with the fluoride ion, which may be depleted excessively through reactions which are not fully understood. In any event, within the parameters set forth herein and as one specific example, a hydrogen peroxide concentration of 1.9 percent or higher, based upon the weight of the solution, will often be excessive, whereas a peroxide concentration below about 0.08 percent by weight will often be ineffective.

The solutions of the invention are most satisfactorily operative in the pH range 1.0 to 4.0, and generally the pH will not exceed 3.0; at higher values, pitting or other surface attack may occur. The solutions also function most satisfactorily at ambient temperatures, although elevated temperatures may be employed, or may develop as a natural consequence of the mechanical action that takes place during treatment. It should be appreciated that temperature can have a very significant effect upon the results produced. As indicated above, aeration of the workpiece surfaces can also have a highly significant effect upon the nature of the chemical reaction that occurs with the solution constituents.

A primary ingredient of the composition and solution of the invention is of course the sulfamic acid compound, which may be provided as the acid itself or as a water-soluble salt thereof. The most desirable source for the fluoride ion content will generally be found to be a bifluoride, and especially ammonium bifluoride, although other water-soluble compounds can be employed instead; e.g., hydrofluoric acid, the alkali metal fluorides such as sodium fluoride, potassium fluoride and sodium bifluoride, ammonium fluoride, the alkaline earth metal fluorides such as calcium fluoride, nickel fluoride, chromium fluoride, etc. Except when it is desired to provide the composition in dry form, the preferred peroxy-group source compound will often be hydrogen peroxide; in such other instances, one of the normally dry peroxy compounds disclosed herein may be employed. It will be appreciated that mixtures of two or more compounds of each species may of course be included in the formulation, if so desired.

The composition and solution of the invention can also contain ingredients other than those previously mentioned. For example, it is now conventional to include one or more surfactants in formulations used for physicochemical refinement of metal surfaces. To be suitable in the present instance, any such surfactant should of course be stable in an acidic peroxide solution; the product known as IGEPAL CO-710 (GAF Chemical Corporation) has been found to be particularly effective. It, and other surfactants suitable for use herein, are disclosed in the aforementioned Michaud et al U.S. Pat. No. 4,906,327, the pertinent portion of which is therefore incorporated hereinto by reference thereto.

Although it is possible to utilize media of an abrasive character, it will usually be preferable to employ a high-density, non-abrasive burnishing media of the nature set forth in the above identified Michaud U.S. Pat. No. 4,818,333. Such media provide maximum uniformity of refinement and metal removal over a workpiece surface, as is most important when the profile of a part is to be preserved as faithfully as possible. The specification of the foregoing patent is accordingly incorporated by reference hereinto, to the extent that such high-density, non-abrasive burnishing media are described therein; briefly, however, it need only be mentioned that the media will be as characterized hereinabove with reference to the preferred embodiments of the instant invention. Apart from considerations as to abrasive characteristics, the size, shape and composition of the media may vary widely, and the choice of media to be used in any given case will be evident to those skilled in the art.

Operation of the vibratory bowl (or other mass finishing equipment utilized) is carried out in a conventional manner, as has been described herein and in considerable detail in the above-identified patents to Michaud et al, Zobbi et al, and Michaud. As will be appreciated, the apparatus (be it a vibratory bowl, a tumbling barrel, etc.) will normally be open or vented to the atmosphere, to most readily permit the necessary oxygenation of the solution; however, closed units designed to achieve the same end might also be feasible if the oxidation capacity of the refinement solution employed is adjusted to compensate for a lack of natural oxygenation.

The preferred mode of operation involves the continuous introduction of fresh solution, with used solution being continuously drawn from the bowl at substantially the same rate (i.e., with "flow-through" operation). Batch and recirculatory flow modes are decidedly less desirable; one reason is that those modes of operation may permit buildup of active by-products and (with replenishment of the solution) of the less rapidly depleted ingredients, leading to excessively high concentrations and, in turn, to surface properties or performance that may be unacceptable.

Finally, it should be emphasized that the formulations, solutions and method of the invention are beneficially used for the surface refinement of titanium and its alloys, which alloys will typically contain one or more of the metals: aluminum, vanadium, molybdenum, tin and zirconium. In many instances the same will also be applied advantageously to nickel and nickel alloys, the latter typically containing cobalt, chromium, titanium, iron, aluminum and/or tungsten.

Thus, it can be seen that the present invention provides novel compositions, and novel aqueous solutions which may be made from them, which solutions are effective for the physicochemical refinement of metal-surfaced objects, and particularly those having surfaces constituted of titanium or nickel, by the mass finishing thereof. The invention also provides a novel mass finishing process utilizing such solutions, and other solutions that are capable of converting such metals to substantially pure oxide forms under normal vibratory mass finishing conditions. Surface refinement is achieved at high rates of speed and with highly uniform metal removal, without causing significant pitting, etching, corrosion, hydrogen embrittlement, or intergranular attack of or upon the workpiece surfaces, and the process is carried out with particular effectiveness in open, vibratory mass finishing equipment.

Having thus described the invention, what is claimed is:

1. In a process for the refinement of titanium or nickel surfaces of objects, the steps comprising:

(a) providing an aqueous solution including water, 0.04 to 1.17 gram mole per liter of a sulfamic acid compound selected from the group consisting of sulfamic acid and water-soluble derivatives thereof, 3.16 to 0.03 gram mole per liter of fluoride ion, and a 0.02 to 0.60 gram mole per liter of a water-soluble peroxy compound, said solution having a pH of about 1.0 to 4.0;

(b) introducing into the container of a mass finishing unit a mass of elements comprising of a quantity of mass finishing media and a mass of objects with metal surfaces, the metal of said surfaces being selected from the group consisting of titanium, nickel, and alloys containing titanium or nickel as the primary constituent;

(c) wetting said mass of elements with said solution;

(d) rapidly agitating said mass of elements while maintaining said surfaces in a wetted condition with said solution so as to produce a stable, physically removable coating thereon, said agitation producing relative movement and contact among said elements; and (e) continuing said agitation step for a period sufficient to effect a significant reduction in roughness of said surfaces through the physical removal of said coating therefrom.

2. The process of claim 1 wherein said quantity of mass finishing media consists of relatively heavy and non-abrasive solid media elements of a size and in an amount selected to promote, under the conditions of agitation maintained, relative sliding movement therefamong and with respect to said objects, said media elements being composed of a mixture of oxide grains fused to a coherent mass having a density of at least about 2.75 grams per cubic centimeter, and being substantially free of discrete abrasive particles, said quantity of media elements having a bulk density of at least about 1.70 grams per cubic centimeter.

3. The process of claim 2 wherein said solution consists essentially of water, a mixture of said sulfamic acid compound and fluoride ion furnishing compound, and said peroxy compound, said sulfamic acid compound constituting 75 to 90 weight percent of said mixture, and said fluoride ion furnishing compound conversely constituting 25 to 10 weight percent thereof, said mixture being admixed with said water in an amount ranging from 15 to 60 grams per liter thereof.

4. The process of claim 3 wherein said sulfamic acid compound is sulfamic acid, said fluoride ion furnishing compound is ammonium bifluoride, and said peroxy compound is hydrogen peroxide.

5. The process of claim 2 wherein the composition of said media elements is such that the average weight reduction thereof is less than about 0.1 percent per hour, as determined in a vibratory bowl having a capacity of about 280 liters, substantially filled with said media elements and operated at about 1,300 revolutions per minute and an amplitude of 4 millimeters, with a soap solution flowing through the bowl at the rate of about 11 liters per hour.

6. The process of claim 2 wherein said agitation step produces continuous oxygenation of said solution.

* * * * *